US006178886B1

(12) United States Patent
Williams et al.

(10) Patent No.: US 6,178,886 B1
(45) Date of Patent: Jan. 30, 2001

(54) REPLACEABLE INKING ARRANGEMENT IN A CAN DECORATOR

(75) Inventors: Robert Williams, Randolph, NJ (US); Mario Gary Padilla, Santa Ana, CA (US)

(73) Assignee: Sequa Corporation, Hackensack, NJ (US)

( * ) Notice: Under 35 U.S.C. 154(b), the term of this patent shall be extended for 0 days.

(21) Appl. No.: 09/387,420

(22) Filed: Aug. 31, 1999

(51) Int. Cl.[7] ..... B41F 31/00
(52) U.S. Cl. ..... 101/349.1; 101/40; 101/DIG. 35
(58) Field of Search ..... 101/37, 40, 40.1, 101/38.1, 36, 348, 349.1, 351.4, 351.1, 352.01, 352.05, DIG. 33, DIG. 35

(56) References Cited

U.S. PATENT DOCUMENTS

| | | | | |
|---|---|---|---|---|
| 3,223,028 | * | 12/1965 | Bringham | 101/40 |
| 3,521,554 | * | 7/1970 | Zurick | 101/40 |
| 3,766,851 | | 10/1973 | Sirvet et al. | 101/40 |
| 5,111,742 | | 5/1992 | DiDonato et al. | 101/40 |
| 5,148,742 | * | 9/1992 | Stirbis et al. | 101/216 |
| 5,740,727 | * | 4/1998 | Shriver | 101/40 |

FOREIGN PATENT DOCUMENTS

| | | | | |
|---|---|---|---|---|
| 7407966 | * | 12/1974 | (NL) | 101/40 |

* cited by examiner

*Primary Examiner*—Daniel J. Colilla
(74) *Attorney, Agent, or Firm*—Mitchell D. Bittman

(57) ABSTRACT

In a can decorator, substituting one inking arrangement by another inking arrangement to facilitate reconfiguration of each inking arrangement with minimal down time while the other inking arrangement is inking cans being decorated. First and second inking arrangements are supported on and spaced 90° or 180° apart around a rotation axis of a plate, which is rotatable to bring each of the inking arrangements to a position radially inward of the can handling apparatus of the can decorator. Each inking arrangement is shiftable laterally inward on the plate away from the can handling apparatus when the plate is to be rotated and laterally shifted outwardly toward the can handling apparatus after the plate has been rotated and the new inking arrangement is positioned laterally inward of the can handling apparatus. In one alternate embodiment, the inking arrangements are on a plate that is reciprocated laterally to bring each inking arrangement in turn to the can handling apparatus. In another alternate embodiment, the inking arrangements are on respective tracks on a Y-shape arrangement to bring each inking arrangement in turn to the can handling apparatus.

35 Claims, 5 Drawing Sheets

REPLACEABLE INKING ARRANGEMENT IN A CAN DECORATOR

BACKGROUND OF THE INVENTION

The present invention relates to can decorating apparatus, to inking arrangements for such apparatus, and particularly to replacing one inking arrangement with another, primarily for facilitating reconfiguring each inking arrangement while the other one is in use for causing minimal down time of the can decorator.

An inking arrangement for a can decorating apparatus includes several individual inkers which are mounted around a rotatable blanket cylinder for applying various color ink patterns to respective blankets on the blanket cylinder. That cylinder in turn transfers the ink color patterns to individual cans presented for decoration by a can handling apparatus. Examples of a continuous motion can printing apparatus of this type are disclosed in U.S. Pat. Nos. 3,766,851 and 5,111,742, incorporated herein by reference. A typical can decorating apparatus is operated to decorate one plurality of cans with one set of ink patterns and to then decorate a succeeding plurality of cans with a different set of ink patterns. As different can decorating patterns may use different ink colors and different ink patterns, the inkers and the blanket cylinder must be reconfigured, i.e. cleaned and/or changed to accommodate the new decorative pattern for the succeeding plurality of cans.

A typical can decorating apparatus includes a single array of inkers inking a single blanket cylinder. When a second plurality of cans is to be printed with a different pattern than was printed on a first plurality of cans, the can decorating apparatus is halted, the individual inkers are cleaned, new or different inks and colors are applied, and the blankets on the blanket cylinder are replaced with new blankets for receiving the new inking patterns. The inking arrangement is then ready for decorating the second plurality of cans. Reconfiguring an inking arrangement in a can decorating apparatus for such a labeling change takes about 22 minutes. During this down time, no cans are being decorated. Changeovers for different can colors and decorations may occur several times during a work day, each with the above noted down time.

An attempt was made in the art to replace an inking arrangement that had been in use with a spare inking arrangement adjacent to the decorating apparatus. Upon conclusion of decoration of one plurality of cans, the first inking arrangement with the blanket cylinder and the inkers was moved out of the operating position and away from the can handling apparatus and another inking arrangement was moved into the operating position at the can handling apparatus for enabling rapid restart of the inking. In particular, the inventor hereof is aware of one prior apparatus that moved inking arrangements in and out of position at the can handling apparatus along a system of tracks with a turntable near the can handling apparatus for positioning each arrangement for inking. It is believed that this prior apparatus was found unacceptable in practice primarily because of the complexity of the track system and the exchange of inkers, and this track system for inking arrangement substitution has been discontinued.

A can decorating installation often includes several can decorating apparatus arranged near to each other. To ease servicing and minimize use of floor space, the apparatus are placed as close together as practicable. An installation using several can decorating apparatus, each with more than one inking arrangement, will take up considerable space. Space is needed between neighboring apparatus so that each inking arrangement can be easily reconfigured for another decorating job. Reducing the space required for several apparatus is desirable.

SUMMARY OF THE INVENTION

Accordingly, it is the primary object of the present invention to reduce the inking pattern changeover time for a can decorating apparatus.

Another object of the invention is to provide an operator of a can decorating apparatus with ease of access to one inking arrangement to be reconfigured after a second inking arrangement has been substituted at a can decorating apparatus.

A further object is to minimize the floor space needed for an installation using several can decorating apparatus and each associated with several inking arrangements.

Another object of the invention is to provide a system which may be installed as a retrofit on existing can decorating apparatus or may be installed in new can decorating apparatus.

According to preferred embodiments of the invention, one inking installation for a can decorating installation includes a first and a second inking arrangement, each including a blanket cylinder and a plurality of inkers supported on the blanket cylinder. In one embodiment, both inking arrangements are supported on a rotatable plate at angularly spaced apart locations, e.g., offset 180° apart in one embodiment or 90° apart in a second embodiment. The inking arrangements are both placed so that their blanket cylinders face radially outward. A single conventional can handling apparatus, including a can supporting mandrel, is arranged opposed in the usual way to the blanket cylinder of the inking arrangement.

Either the 180° or the 90° angular offset or perhaps another angular offset between the inking arrangements is selected for convenience, providing sufficient space for an operator to work between the inking arrangements for cleaning and ink changing, etc. which is needed at each printing reconfiguration. A shorter angular spacing might reduce plate rotation time, which is a desirable benefit.

The second inking arrangement is angularly offset to and therefore is to the side of the first inking arrangement, so that the second inking arrangement is accessible to a machine operator who can reconfigure the then out of use inking arrangement for the next plurality of cans to be decorated. At the conclusion of a decorating run of one plurality of cans and when it is desired to change to the next can decorating program, the then operative inking arrangement, comprised of a blanket cylinder and inkers, is shifted radially inwardly on the rotatable plate a short distance away from the can handling apparatus. The inking arrangement is shifted radially far enough to clear the can handling apparatus of the decorator. Then the plate can be moved, and particularly rotated, without endangering or permitting contact with the can handling apparatus or the inking arrangements. For example, the inking arrangement may be shifted by being retracted laterally about two feet (about 60 cm), which disengages the inking arrangement and clears any possible contact with the can handling apparatus. The plate is then rotated, e.g. by 180° or 90°, to bring the second, now reconfigured, inking arrangement to the can handling apparatus. When the second inking arrangement is at the can handling apparatus, plate rotation is halted. The second inking arrangement including the blanket cylinder and the inkers is shifted laterally outward on the plate to the operative position at the can handling apparatus.

The present invention contemplates other techniques for moving the first and second inking arrangements into and out of the operating position at the can handling apparatus and for reconfiguration and servicing.

In one of these alternative embodiments, each of the inking arrangements or apparatus is movable along a respective track. The tracks merge the paths of the inking arrangements when they are at the can handling apparatus. After the inking arrangements are retracted slightly from the can handling apparatus, the tracks diverge, producing a Y-shaped configuration wherein each inking arrangement is moved out along its respective leg of the Y for reconfiguration and each inking arrangement is moved in along its leg of the Y to the can handling apparatus when a change in inking configuration is needed.

In yet another embodiment, both of the inking arrangements are mounted on a laterally movable or reciprocable plate which is selectively movable when both individual inking arrangements are retracted back from the can handling apparatus, so that one inking arrangement can be brought to the can handling apparatus while the other inking arrangement is moved laterally away for reconfiguration. When one inking arrangement has been laterally shifted to be at the can handling apparatus, it is then shifted a short distance selectively toward and away the can handling apparatus for providing the inking and is thereafter shifted away from the can handling apparatus to enable the lateral moving of the plate to enable substitution of the other inking arrangement which was reconfigured.

It is the inventors' present goal to perform a substitution of a first to a second inking arrangement in less than five minutes, with a target of perhaps even less than one minute. Clearly, there would be a great time saving using two inking arrangements, with the inking arrangement then out of service being reconfigured to a new can decorating program so that it is ready for rapid substitution. It is estimated that the additional cost of having a second inking arrangement on a can decorator would be paid back in at most a year due to the down time saving.

Other objects and features of the present invention will be apparent from the following description and accompanying drawings disclosing a preferred embodiment.

DESCRIPTION OF THE PREFERRED EMBODIMENT

Figure 1:
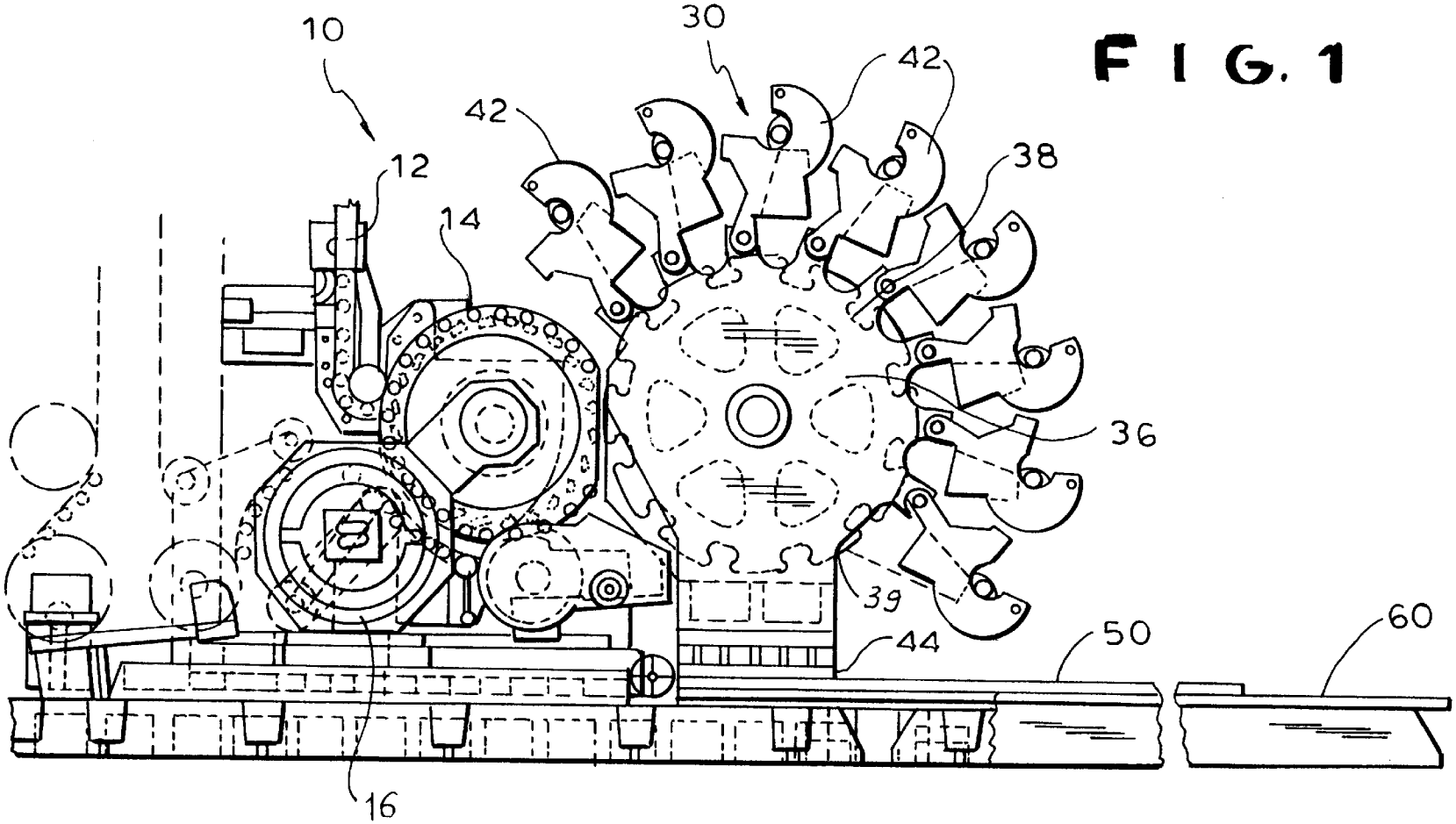
FIG. 1 is a side view of a can decorating apparatus according to the a first embodiment of the invention.

FIG. 1 shows a side view of a can decorating apparatus 10 according to the invention which includes a conventional, can handling apparatus including a feed 12 for cans, a slotted mandrel wheel 14 for carrying the cans past a blanket cylinder 38 of an inking arrangement and a discharge arrangement 16 for discharging the cans from the mandrel wheel 14 after they have been printed. These elements are not disclosed in greater detail, as examples thereof are shown in above noted U.S. Pat. Nos. 3,766,851 and 5,111,742, incorporated herein by reference, as well as in numerous other patents and publications.

Figure 2:
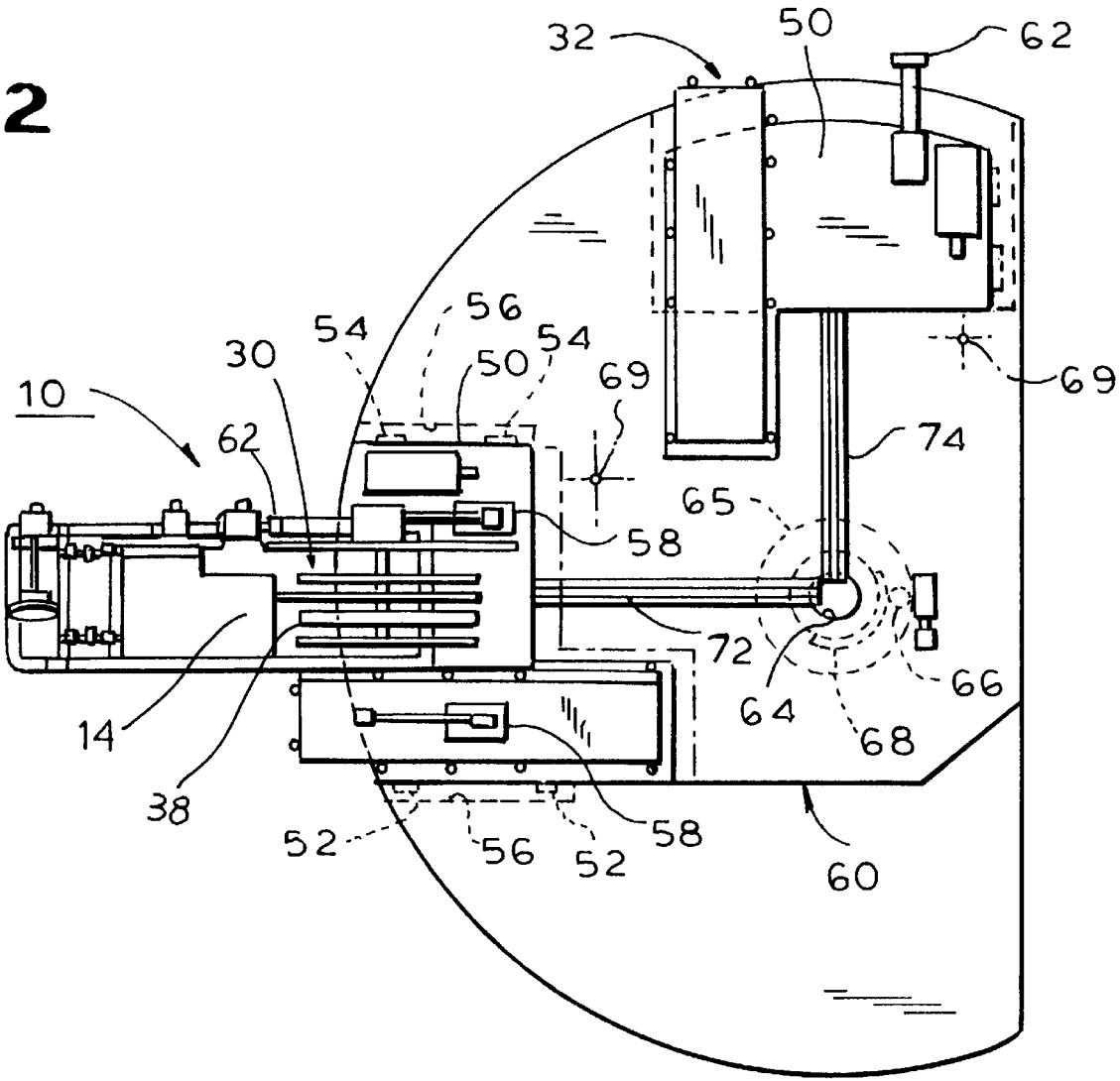
FIG. 2 is a top plan view of the first embodiment thereof.

As shown in FIG. 2, associated with the above described can handling apparatus 12, 14, 16 are a first inking arrangement 30 and a second essentially identical inking arrangement 32. The inking arrangements 30, 32 are also of conventional design, except for the invention herein. The structure of a representative inking arrangement is shown in the above patents, incorporated by reference, as well as in numerous other patents and publications showing inking arrangements for can decorators. In particular, as relevant here, as shown in FIG. 1, an inking arrangement 30 includes a frame 36 which supports a blanket cylinder 38 which includes several ink pattern application blankets 39, wherein each blanket 39 is to be inked by a respective conventional inker 42. The blanket cylinder 38 rotates past the can support mandrel wheel 14 and the cans in the mandrel wheel slots are decorated by the blankets on the blanket cylinder as the blanket cylinder rotates past.

The blanket cylinder 38 with its inkers, which together comprise an inking arrangement 30, is a physically separated unit from the can handling apparatus 12, 14, 16. As seen in FIG. 1, the blanket cylinder frame 36 which supports the inkers 42 is supported on a base 44 which in turn is supported on the inking arrangement laterally shiftable platform 50. The platform 50, in turn, is laterally shiftable on a rotatable plate 60, which is illustrated in FIG. 2 as having the shape of a partial circle with an arcuate extent greater than 180°. The circular shape of the plate 60 is suggested for convenience of mounting, supporting and moving the first and second inking arrangements 30, 32. Other shape plates which would provide support as needed and which are strong enough may be used instead.

As shown in FIG. 2, there is a respective pair of stationary rollers 52 at one lateral side and another pair 54 at the other lateral side of the laterally shiftable platform 50 for the inking arrangement 30. The underside of the platform 50 has appropriately shaped channels 56 for receiving the rollers therein. The rollers enable the platform 50 to be shifted laterally about 2 feet (about 60 cm) from the operative radially outward position shown for the inking arrangement 30, to the inoperative position shown for the inking arrangement 32 with the arrangement 32 retracted inward laterally about two feet (60 cm).

There are piston-cylinder units 58 at platform 50 at both sides of the blanket cylinder, which are operated in coordination. One end of the piston-cylinder unit is attached to the platform 50 and the other end to the plate 60 with respect to which the platform 50 and the inking arrangement 30 shift laterally.

There is an air activated clutch 62 associated with a piston-cylinder arrangement 58 for connecting the drives for the can handling and the inking apparatus when an inking arrangement 30 is in the inking position at the can handling apparatus.

The plate 60 is supported to rotate around a pivot at axis 64. The plate is supported on an air bearing 65. When the air bearing is activated, it supports the plate 60 for easy rotation. As an alternative to an air bearing, a hydraulic system may be used to enable rotation of plate 60. A gear drive rotates the platform 60. It includes a driven pinion 66 which drives a main drive gear 68 which is connected to the plate 60 and is rotated around the pivot 64. There are locator pins 69 associated with the plate 60 and connected with a base below the plate so that upon completion of rotation, the plate is correctly oriented with the respective inking arrangement positioned for each can decoration.

The individual inking arrangements 30, 32 are supplied with required fluids including air, ink, lubrication, etc., through respective hoses 72, 74 that pass through the pivot 64 and lead to the respective inking arrangements 30 and 32. Other arrangements for delivery of fluids may be used.

One sequence of operation of the apparatus is suggested.

Upon completion of a decorating run on a first plurality of cans and when it is desired to reconfigure the can decorator for another decorating run on a second plurality of cans, first the single position drive clutch 62 that is between the spindle disk or mandrel wheel 14 and the blanket cylinder drive gear boxes is disengaged, so that there is no longer cooperating rotation between the mandrel wheel 14, the cans and the blanket cylinder 38. With the blanket cylinder and the can handling apparatus halted, the inking arrangement 30 is disengaged from the remainder of the can handling apparatus 12, 14, 16. The air cylinders 58 are operated to shift and particularly laterally retract the platform 50 along with the inking arrangement 30 from the radially outward operating position of the previously operative first inking arrangement 30 to the approximately two feet (60 cm) retracted position of the soon to be operative second inking arrangement 32. The rotatable plate 60 had been held securely against rotation by a vacuum hold-down during this operation. The vacuum hold-down on plate 60 is deactivated. Now the air bearing 65 for the plate 60 is activated, which supports the plate 60 so that it might be easily rotated. The plate locator pins 69 are retracted to free the plate to rotate. Next the gear motor leading to the drive gears 66, 68 is activated and moves, particularly by rotating, the plate 60 counterclockwise by 90° to move the second inking arrangement 32 into the rotative position of the inking arrangement 30. This also moves the inking arrangement 30 by 90° to an inoperative position, not shown. When the plate 60 has been rotated enough to bring the second inking arrangement 32 to a location radially inward of the can handling apparatus, the plate locator pins 69 are activated to again lock the plate in the correct position. The plate air bearing 65 is deactivated. Then the plate vacuum hold-down is reactivated, the piston-cylinder connection 58 shifts the second inking arrangement 32 laterally outward to position the blanket cylinder 38 to ink cans on the mandrel wheel 14. The clutch 62 is then reactivated and the can holding arrangement 12, 14, 16 and the inking arrangement 32 are reactivated and ready for operation. It is hoped that the time period between disengagement of the clutch connection 62 between the can handling and the first inking arrangement 30 and the reconnection of the can handling apparatus to the second inking arrangement 32 so that cans can be printed, can be as short as 60 seconds. Although as much time as a few minutes might pass, it will certainly be much less than the down time now experienced when a single inking arrangement is used that is not substituted for when a succeeding can plurality is to be printed.

During the time while the second inking arrangement 32 is operating, the first inking arrangement is to the side, available for reconfiguration. When the next plurality of cans is to be decorated, the procedure described above is repeated, this time withdrawing inking arrangement 32 and rotating the plate 60 clockwise to return reconfigured inking arrangement 30 to the illustrated position at the can handling apparatus. In the 90° embodiment illustrated in FIG. 2, the plate 60 is approximately twenty feet in diameter, but in order to allow an operator sufficient space to work on the inoperative inking arrangement 30, 32, thirty two feet of total clearance space is recommended. The clearance space is selected so that two other complete arrangements 10 can be placed on either side of the arrangement 10 illustrated in this Figure and each arrangement can be serviced and reconfigured without physical interference from the other arrangements or from operators working on them.

Figure 3:
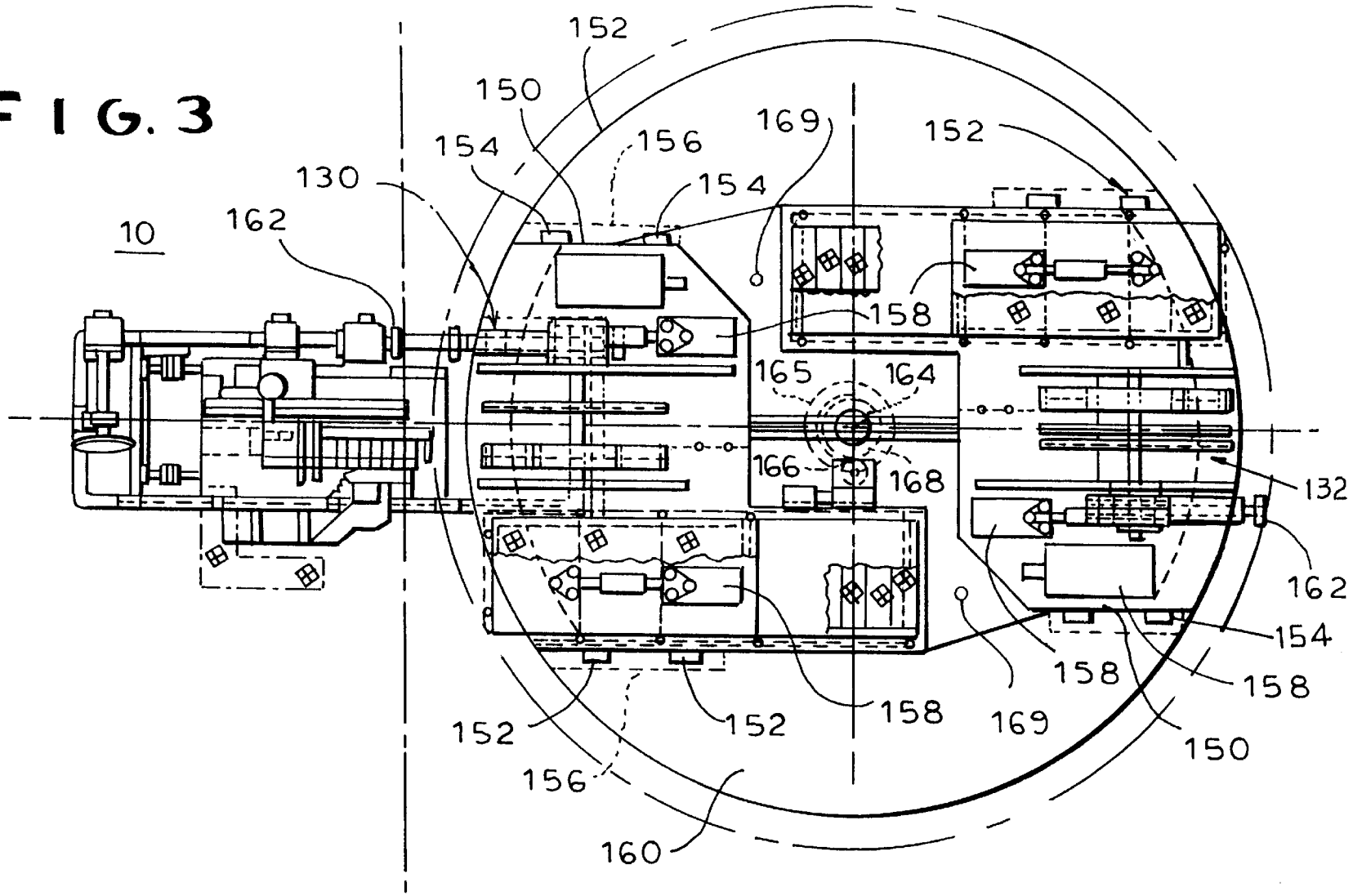
FIG. 3 is a top plan view of a second embodiment of the present invention.

FIG. 3 illustrates a second and preferred embodiment of the present invention in which like elements to those in FIGS. 1 and 2 have the same numbers, raised by 100. The two inking arrangements 130 and 132 mounted on rotating plate 160 are spaced 180° apart, not 90° apart as in the embodiment in FIG. 2. As with the first embodiment illustrated in FIG. 2, the two inking arrangements 130 and 132 are essentially identical in structure to each other. In contrast to the embodiment illustrated in FIG. 2, the rotatable plate 160 of the embodiment illustrated in FIG. 3 rotates in a complete circle.

Each of the inking arrangements 130 and 132 is again laterally shiftable on stationary rollers 154, 152 disposed in channels 156 beneath the platforms 150 on which the inking arrangements 130, 132 are mounted. The platforms 150 are capable of being shifted laterally about 2 feet (about 60 centimeters) from the operative outward position shown for arrangement 130 in FIG. 3. Piston cylinder-units 158 operate in coordination to shift the platform 150 laterally with respect to the rotatable plate 160.

Air activated clutch 162, operated in conjunction with the piston cylinder arrangements 158 connects the drives for the can handling and inking apparatus when an inking arrangement 130, 132 is in the inking position at the can handling apparatus.

As in the previously described embodiment of FIG. 2, the rotatable plate 160 is supported to rotate about a pivot at axis 164. The plate is supported on an air bearing 165. The gear drive, including a driven pinion 166 which drives a main gear drive 168 which is connected to plate 160, operates to rotate the plate 160 about the pivot point 164. Locator pins 169 ensure that the plate 160 is correctly oriented with respect to the can handling apparatus. In contrast to the embodiment of FIG. 2 which rotates the plate 60 through an angle of approximately 90°, the plate 160 of the embodiment depicted in FIG. 3 is rotated through an angle of 180° to exchange inking apparatus 130 and 132.

As described with respect to the previous embodiment of FIG. 2, in the embodiment of FIG. 3, each of the inking units 130 and 132 must be shifted laterally toward the center of plate 160 in order to provide the proper clearance away from the can handling apparatus. As previously described with respect to the 90° embodiment depicted in FIG. 2, the 180° embodiment also requires clearance such that operators can reconfigure or service the inoperative inking apparatus 130 or 132. In the 180° embodiment, approximately 22 feet of clearance from the neighboring inking apparatus is required, in contrast to the 32 feet of clearance required for the 90° embodiment. This is because in its inoperative position, each inking apparatus 130, 132 is positioned such that an operator is not standing between two arrangements 10, as in the embodiment of FIG. 2. For this reason, the 180° embodiment may be preferred over the 90° embodiment.

Figure 4:
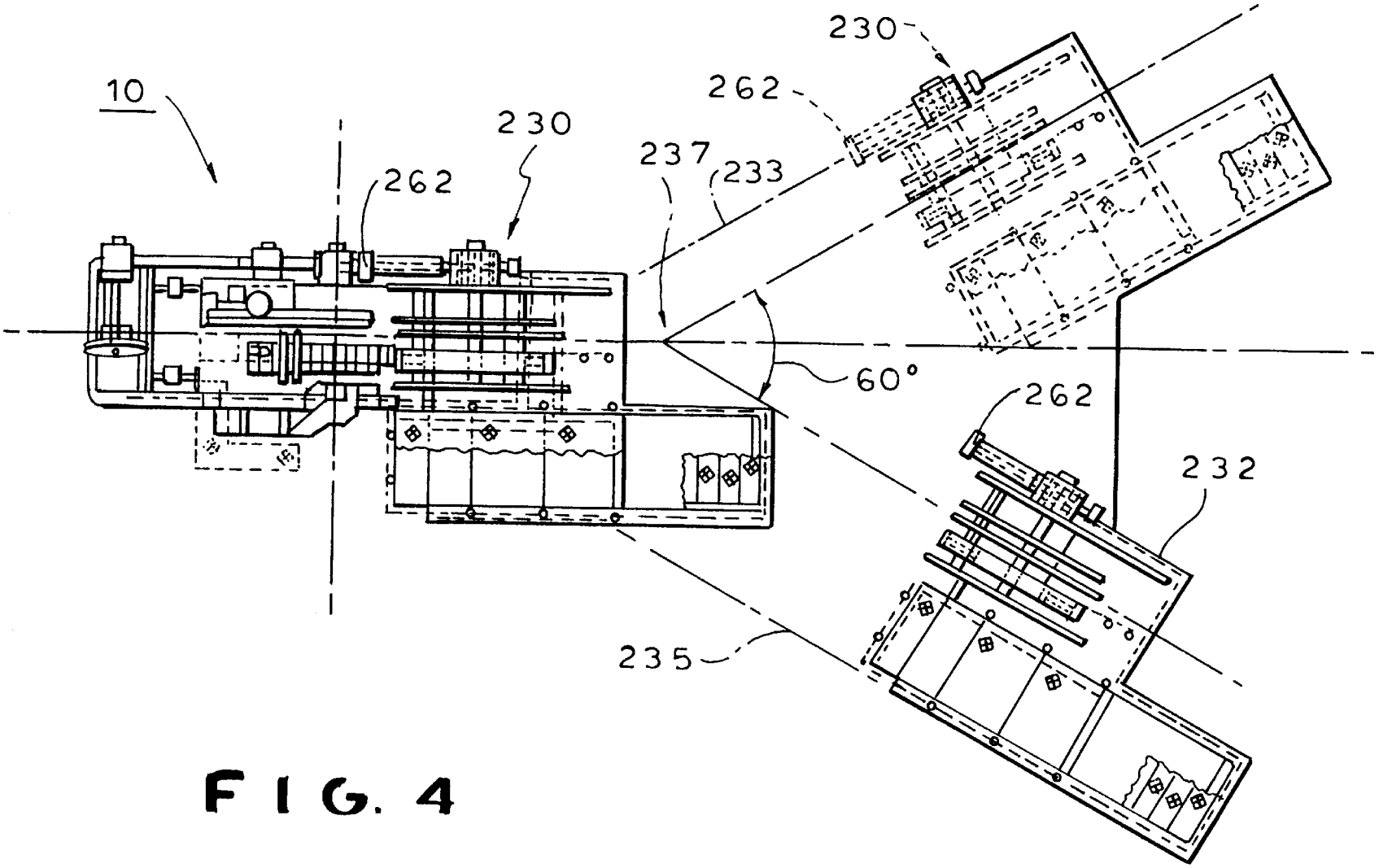
FIG. 4 is a top plan view of a third embodiment of the present invention.

FIG. 4 illustrates a third embodiment of the present invention in which like elements to those in FIG. 3 have the same numbers raised by another 100. In this embodiment, two inking apparatus 230, 232 are moved into and out of their operative positions on a track system. In a preferred form of the third embodiment, the respective tracks 233, 235 for each apparatus 230, 232 meet in a generally Y-shaped configuration, and there is a separation angle of approximately 60° between the tracks of inking apparatus 230, 232.

The two tracks may meet just outside the position where an inking apparatus is to be moved into its operative position at the can handling apparatus 10. The separate tracks may merge into a single track in a railroad type switch 237. Alternatively, each track system may remain separate, and one track for one apparatus may cross a track for the other apparatus to position each inking apparatus at the can handling apparatus and without need for a track switch. The Y-shape is suggested to enable each inking arrangement to be moved to avoid interfering with movement of the other one. Shapes generally Y-like might achieve the same result.

FIG. 4 illustrates the inking apparatus 230 in solid line in the operative position connected to the can handling apparatus 10 via clutch 262. FIG. 4 also includes a chain link depiction of inking apparatus 230 in the inoperative position withdrawn from the apparatus 10. Inking apparatus 232 is shown in FIG. 4 in its retracted inoperative position. Each inking apparatus is retractable far enough so as to not interfere with the movement of the other.

To exchange the two inking apparatus 230, 232, the apparatus 230 is disengaged by straight short distance retraction away from the can handling apparatus 10. The track 233 is there turned to shift the path of the apparatus 230 by approximately 30° from the orientation squarely facing the can handling apparatus 10 and then the inking apparatus 230 is displaced along its inclined track into its final inoperative position illustrated in broken lines in FIG. 4. The angle of displacement of the track and the distance of displacement of the inking apparatus along the track are sufficient so that displacement of each inking apparatus along its track is not interfered with by the presence of the other inking apparatus. Once the inking apparatus 230 has been moved to its inoperative position, the inking apparatus 232 can be moved into its operative position along its track pathway as described above.

Implementation of a specific track system for moving inking apparatus 230, 232 would be apparent to those skilled in the art. In a first implementation of the third embodiment, the apparatus 230 and 232 are mounted on two completely separate track systems 233, 235. The two track systems are slightly laterally displaced from each other in the area of the operative position of the inking apparatus 230, 232 at the apparatus 10. The wheels or rails (not shown) mounted to and support the inking apparatus 230, 232 aligned with the can apparatus 10 in the operative area. Near the can handling apparatus 10, the tracks bend approximately 30° between their orientations at their operative positions and their inoperative positions as illustrated in FIG. 4.

In an alternative implementation of this third embodiment, a single common set of tracks is used in the operative area near the can handling apparatus 10 and separate tracks are used to move the inking apparatus 230, 232 to their respective inoperative positions. In this implementation, a railroad track type of switch connect the "inoperative" tracks with the "operative" tracks.

In a third implementation (not shown) of this third embodiment, a common rotating platform may be used to position the inking apparatus 230, 232 in the operative and inoperative positions. Upon disengagement from the can handling apparatus 10, an inking apparatus 230, 232 is radially displaced out of the operating position onto the platform, the rotating platform is rotated approximately 30° to engage a set of "inoperative" tracks and the inking apparatus 230, 232 is moved to its inoperative position on the "inoperative" tracks. The rotating platform is then rotated 60° to engage the other set of "inoperative" tracks carrying the other inking apparatus 230, 232. The other inking apparatus 230, 232 is then moved onto the rotating platform and onto the common set of tracks. The rotating platform is then rotated through 30° to thus align the inking apparatus 230, 232 with the can handling apparatus 10. The inking apparatus 230, 232 is then outwardly laterally displaced with respect to the platform and to engage the can handling apparatus 10.

Figure 5:
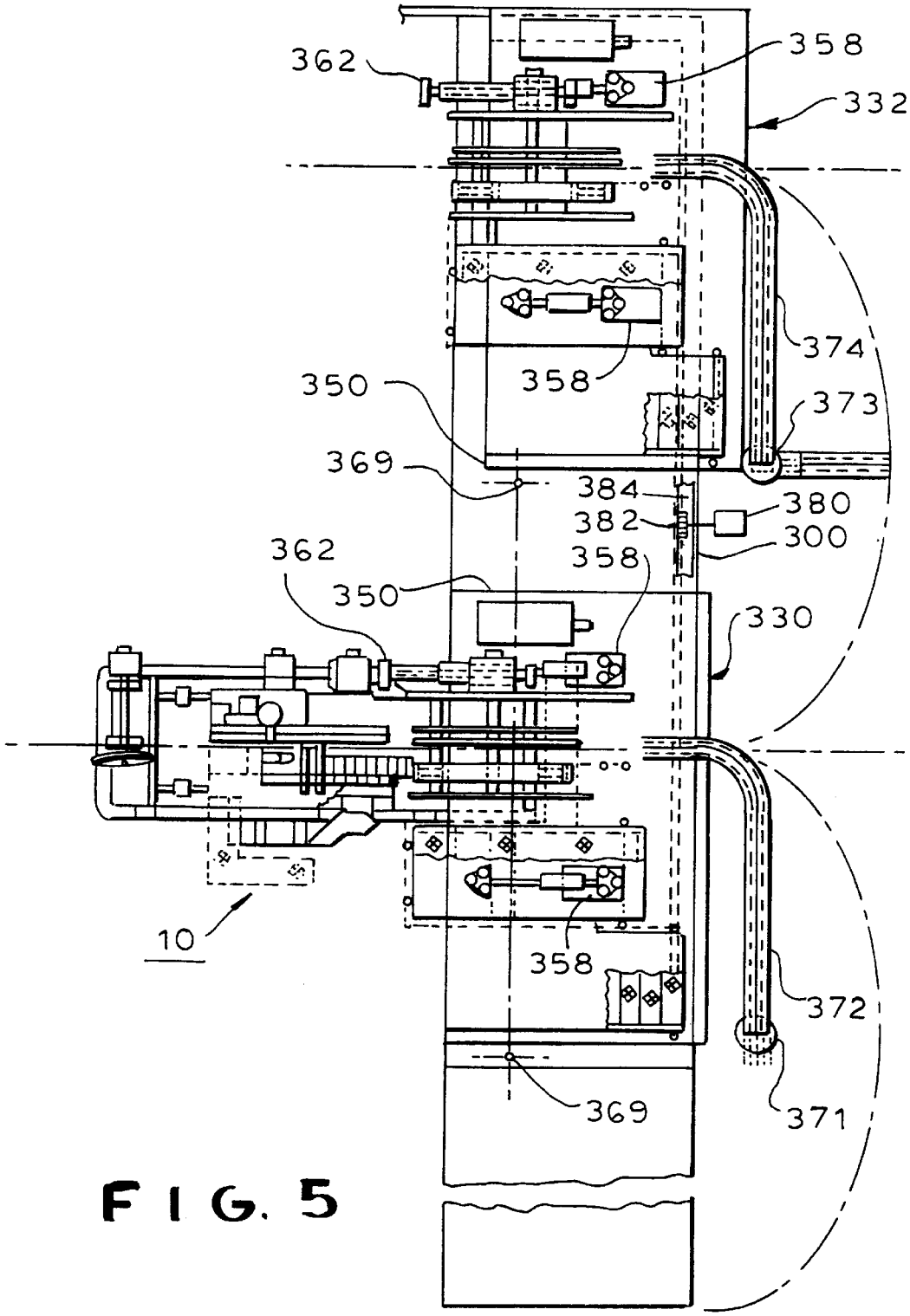
FIG. 5 is a top plan view of a fourth embodiment of the present invention.

FIG. 5 illustrates a fourth embodiment of the present invention. Elements in this embodiment that correspond to those in the preceding third embodiment have the same reference numbers raised by another 100. The inking apparatus 330, 332 are identically oriented on a top plate 300 that shifts both inking apparatus laterally, i.e, up or down in FIG. 5. Similar to the embodiments illustrated in FIGS. 2 and 3, the inking apparatus 330 and 332 are mounted on respective shiftable mounting plates 350 on the plate 300. The mounting plates 350 are individually displaceable toward and away from the can handling apparatus 10, i.e., left or right in FIG. 5, with respect to the top plate 300 by respective cylinder piston arrangements 358.

The fluids for the inking apparatus 330, 332 are supplied through flexible hose arrays 372 and 374, respectively. The hose arrays 372, 374 are connected to their inking apparatus 330, 332 through pivot locations 371, 373, which are located approximately midway through the range of lateral travel of the inking apparatus.

Inking apparatus 330 is at its operative position with the plate 300 located laterally to position the apparatus 330 at the can handling apparatus and with the apparatus 330 shifted transversely toward the apparatus 10 to be able to ink the cylinder. Upon completion of a printing operation on cans at the apparatus 10, the single position drive clutch 362 between the apparatus 10 and 330 is disengaged. A vacuum hold down (not shown) for inking apparatus 330 is deactivated thus permitting movement of the mounting plate 350 with respect to the top plate 300. An air bearing (not shown) for the mounting plate 350 for inking apparatus 330 is then activated to ease shifting of the plate 350 on the plate 300. The cylinders 358 are activated to retract the inking apparatus 330 away from the can handling apparatus 10 i.e., to the right in FIG. 5. As in the previous embodiments, the inking apparatus 330 is retracted approximately 2 feet (about 60 cm) in order to provide clearance between the inking apparatus 330 and the can handling apparatus 10. After the retraction, the air bearing for the mounting plate 350 is deactivated and the vacuum hold down for inking apparatus 330 is again activated.

Both inking apparatus 330 and 332 are retracted on plate 300. A vacuum hold down (not shown) for the common top plate 300 is deactivated and an air bearing (not shown) for the plate 300 is activated. The air bearing permits the linear lateral traversing movement of the top plate 300 with the inking apparatus 330 and 332 mounted on it. A locator pin 369 for the top plate 300 is retracted in order to enable the movement of the top plate 300. A rack and pinion drive mechanism 380 with a driven pinion 382 engaging a rack 384 extending along the plate 300 operates to move the top plate 300 laterally to move the second inking apparatus 332 into position for engaging with the can handling apparatus 10. In a preferred implementation of the present embodiment, the inking apparatus 330, 332 are spaced sufficiently so that each can be reconfigured while the other is inking and they are spaced to avoid need for excessive lateral shifting of the plate 300. For example, this distance of travel of plate 300 is approximately 17 feet. The plate 300 moves in a direction transverse to the direction in which the inking arrangements shift toward and away from the apparatus 10.

When the second inking apparatus 332 is positioned for engaging apparatus 10, the top plate locator pin 369 is engaged to fix the position of the top plate 300 and the air bearing for the top plate 300 is deactivated while the vacuum hold down for top plate is activated.

As the top plate 300 is linearly displaced with respect to the can handling apparatus 10, the utility lines 372 and 374 rotate about their respective pivots 371 and 373, approximately 180°, between inking apparatus positions.

With the second inking apparatus 332 at the can handling apparatus 10, the vacuum hold down for the mounting plate 350 for the inking apparatus 332 is deactivated and the air bearing for the mounting plate 350 is activated. Cylinders 358 move the mounting plate 350 and inking apparatus 332 forward into engagement with the can handling apparatus 10, and the single position clutch 362 is engaged. With the inking apparatus 332 in its engaged position, the air bearing on the mounting plate 350 for the inking apparatus 332 is deactivated, and the vacuum hold down for mounting plate 350 is activated. During the time the inking apparatus 332 is inking the can handling apparatus, the other inking apparatus may be reconfigured for the next inking job. Then when the next inking procedure is to be performed, the above described procedure is followed to bring the first inking apparatus 330 back to its location to ink the can handling apparatus.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed:

1. An inking apparatus for a can decorator, wherein the can decorator includes a can handling apparatus for presenting cans to be decorated by the inking apparatus;

the inking apparatus comprising:

a first and a second inking arrangement and a presenting apparatus for presenting one of the first and second inking arrangements at a time to the can handling apparatus;

each of the inking arrangements comprising:

a frame;

a blanket cylinder supported for rotation on the frame and including blankets thereon for applying respective color decorations to the cans on the can handling apparatus passing by the blanket cylinder;

a respective set of inkers, each inker being positioned and adapted to hold and dispense a respective ink supply with a selected pattern to a respective one of the blankets on the blanket cylinder;

the presenting apparatus comprising a support on which each of the first and second inking arrangements is supported at spaced apart locations on the plate;

a drive for moving the support for selectively moving one of the first and second inking arrangements to a position at the can handling apparatus;

a respective inking arrangement shifting device connected between each inking arrangement and the support for shifting the inking arrangement toward or away from the can handling apparatus when the inking arrangement has been moved by the support to the position at the can handling apparatus, the inking arrangement being shiftable on the support away from the can handling apparatus far enough to permit the support to move the inking arrangement which is then at the can handling apparatus away from the can handling apparatus without such movement being inhibited by the can handling apparatus and far enough to permit the support to move the other inking arrangement to the can handling apparatus, and each of the inking arrangements being shiftable by the respective inking arrangement shifting device to be moved toward the can handling apparatus where the inking arrangement may be operated to decorate the cans on the can handling apparatus.

2. The apparatus of claim 1, wherein the support comprises a plate supported to move by being rotated around a rotation axis and the drive rotates the plate around the axis for moving each of the first and second inking arrangements selectively to the can handling apparatus.

3. The apparatus of claim 2, wherein each of the inking arrangements is at an equal radial distance from the rotation axis.

4. The apparatus of claim 2, further comprising an apparatus for enabling rotation of the plate around the axis.

5. The apparatus of claim 2, wherein the plate drive comprises a first gear connected to the plate and a driven pinion gear driving the first gear to rotate.

6. The apparatus of claim 2, wherein the plate and the inking arrangements are respectively located so that the can handling apparatus is radially outward of the inking arrangements from the axis, and each inking arrangement is shifted laterally outward to the can handling apparatus.

7. The apparatus of claim 6, wherein each inking arrangement is supported on the plate to be shifted laterally with respect to the rotation axis of the plate between the positions of the inking arrangement away from and toward the can handling apparatus.

8. The apparatus of claim 7, wherein each inking arrangement shifting device comprises a piston-cylinder connection between the inking arrangement and the plate and operable for shifting the inking arrangement between its positions.

9. The apparatus of claim 8, further comprising respective rollers on the plate for each inking arrangement, and each inking arrangement rides on the respective rollers for shifting between its positions.

10. The apparatus of claim 2, further comprising fluids supply connections to each of the inking arrangements and extending from the axis of the plate to each of the inking arrangements for delivering fluids to the inking arrangements.

11. The apparatus of claim 2, further comprising locator elements on the plate for locating the plate at the two rotative locations where one of the first and second inking arrangements is positioned at the can handling apparatus.

12. The apparatus of claim 2, wherein the first and second inking arrangements are 90° apart around the rotation axis.

13. The apparatus of claim 2, wherein the first and second inking arrangements are 180° apart around the rotation axis.

14. The apparatus of claim 1, wherein the can handling apparatus faces in one direction to receive the inking apparatus, both of the first and second inking apparatus on the support face in the same direction to ink the cans on the handling apparatus, and the support is operable to move the inking apparatus laterally to bring each of the inking apparatus in turn to the can handling apparatus.

15. The apparatus of claim 14, further comprising locator elements on the support for selectively locating the support where one of the first and second inking arrangements is positioned at the can handling apparatus.

16. The apparatus of claim 14, further comprising a fluids supply connections to each of the inking arrangements, the fluids supply connections being pivotable as the plate is moved.

17. The apparatus of claim 14, wherein each inking arrangement shifting device comprises a piston-cylinder connection between the inking arrangement and the plate and operable for shifting the inking arrangement on the plate.

18. The apparatus of claim 1, wherein each inking arrangement shifting device comprises a piston-cylinder connection between the inking arrangement and the support and operable for shifting the inking arrangement toward or away from the can handling apparatus.

19. The apparatus of claim 18, further comprising respective rollers on the support for each of the inking arrangements, and each inking arrangement rides on the respective rollers for shifting between its positions.

20. The apparatus of claim 1, further comprising fluids supply connections to each of the inking arrangements and extending from the support to each of the inking arrangements for delivering fluids to the inking arrangements.

21. The apparatus of claim 1, further comprising locator elements on the support for locating the support at the two locations where the respective one of the first and second inking arrangements is positioned at the can handling apparatus.

22. An inking apparatus for a can decorator, wherein the can decorator includes can handling apparatus for presenting cans to be decorated by the inking apparatus;

the inking apparatus comprising:

each of the inking arrangements comprising:

a frame;

a blanket cylinder supported for rotation on the frame and including blankets thereon for applying respective color decorations to the cans on the can handling apparatus passing by the blanket cylinder;

a respective set of inkers, each inker being positioned and adapted to hold and dispense a respective ink supply with a selected pattern to a respective one of the blankets on the blanket cylinder;

a first presenting apparatus for presenting the first inking arrangement to and moving it away from the can handling apparatus, a second presenting apparatus for presenting the second inking arrangement to and moving it away from the can handling apparatus; the first and second presenting apparatus defining respective legs of generally a Y-shape configuration with respect to the can handling apparatus;

first and second drives for the first and second inking arrangements respectively for driving the inking arrangements along the respective legs of the Y-shape and the first and second presenting apparatus having a common part of the Y shape at the can handling apparatus where they position one of the first and second inking arrangements to the can handling apparatus at a time.

23. The apparatus of claim 22, wherein each of the first and second presenting apparatus comprise a respective track for the inking arrangement and the tracks are oriented in the generally Y-shape configuration with a region of the tracks at the stem of the generally Y-shape near the can handling apparatus.

24. The apparatus of claim 23, wherein the first and second presenting apparatus share a common track in the generally Y-shape thereof near the can handling apparatus.

25. The apparatus of claim 24, further comprising a switching device to switch the first and second inking arrangements to the common track.

26. A method for replacing a first inking arrangement with a second inking arrangement at a can handling apparatus of a can decorating apparatus, the method comprising:

shifting a first inking arrangement which is located at the can handling apparatus in a first direction for separating the first inking arrangement from the can handling apparatus;

then moving the first inking arrangement in a second direction different from the first direction and away from the can handling apparatus for enabling the first inking arrangement to be accessible for reconfiguring the first inking arrangement while simultaneously moving the second inking arrangement in the second direction to the location at the can handling apparatus;

then shifting the second inking arrangement in a third direction opposite the first direction and toward the can handling apparatus for shifting the second inking arrangement into position to ink the cans on the can handling apparatus.

27. The method of claim 26, wherein the second direction is across the first direction.

28. The method of claim 26, wherein the first direction is along a first path and the second direction is along a second path, the second path is angled off from the first path and the third direction is on a third path angled off from the first and second paths defining a generally Y-shape with the first path as the stem of the Y and the second and third paths as the legs of the Y.

29. The method of claim 28, further comprising when moving the second inking arrangement in the third direction, moving the first inking arrangement far enough in the second direction so that the inking arrangements do not interfere with the movement of each other.

30. A method for replacing a first inking arrangement with a second inking arrangement at a can handling apparatus of a can decorating apparatus, comprising of the steps of:

after operation of the first inking arrangement for applying ink to cans on the can handling apparatus, shifting the first inking arrangement away from the can handling apparatus in a radial direction with respect to an axis of rotation;

rotating the first inking arrangement around the axis and away from the can handling apparatus and simultaneously rotating the second inking arrangement around the axis to a position radially inward of the can handling apparatus and then halting rotation of the inking arrangements;

shifting the second inking arrangement in a radial direction to the can handling apparatus into position for inking cans to be decorated presented by the can handling apparatus.

31. The method of claim 30, further comprising repeating the method by shifting the second inking arrangement radially away from the can handling apparatus;

then rotating both of the second and the first inking arrangements around the axis of rotation to bring the first inking arrangement to a position radially inward of the can handling apparatus, and halting the rotation of the inking arrangements;

then shifting the first inking arrangement laterally to the can handling apparatus.

32. The method of claim 31, wherein the first and the second inking arrangements are supported on a plate and the inking arrangements are rotated around the axis by rotating the plate around the axis.

33. The method of claim 32, wherein the inking arrangements are supported on the rotatable plate and the inking arrangements are each shiftable laterally on the plate.

34. The method of claim 31, wherein the first and second inking arrangements are rotated over an angle of 90°, back and forth, to bring each of the inking apparatus in turn to the can handling apparatus.

35. The method of claim 31, wherein the first and second inking arrangements are rotated over an angle of 180°, to bring each of the inking apparatus in turn to the can handling apparatus.

* * * * *